United States Patent [19]

Fung

[11] 4,199,326

[45] Apr. 22, 1980

[54] EMULSIFIED FUEL COMPOSITION AND SURFACTANT USEFUL THEREIN

[76] Inventor: Paul S. T. Fung, 10th Floor, Universal Bldg., 522 Tun Hwa S. Rd., Taipei, Taiwan

[21] Appl. No.: 888,641

[22] Filed: Mar. 23, 1978

[51] Int. Cl.[2] ..... C10L 1/32

[52] U.S. Cl. ..... 44/51; 252/356

[58] Field of Search ..... 44/51; 252/356

[56] References Cited

U.S. PATENT DOCUMENTS

| | | | |
|---|---|---|---|
| 1,614,559 | 1/1927 | Kirschbraun . | |
| 1,614,560 | 1/1927 | Kirschbraun | 44/51 |
| 1,614,735 | 1/1927 | Kirschbraun | 44/51 |
| 2,603,557 | 7/1952 | Roush | 44/51 |
| 3,540,866 | 11/1970 | Miller | 44/51 |
| 3,776,857 | 12/1973 | Lindner | 44/51 |
| 3,807,972 | 4/1974 | Miller | 44/51 |
| 3,902,869 | 9/1975 | Friberg et al. | 44/51 |
| 4,083,698 | 4/1978 | Wenzel et al. | 44/51 |

*Primary Examiner*—Delbert E. Gantz
*Assistant Examiner*—Y. Harris-Smith
*Attorney, Agent, or Firm*—Quaintance, Murphy and Richardson

[57] ABSTRACT

An emulsified fuel composition comprising fuel oil, water, and a surfactant. The surfactant comprises nitrobenzene, benzene, a fatty monocarboxylic acid, an alkylene oxide condensate, and a hydrocarbon oil.

2 Claims, No Drawings

EMULSIFIED FUEL COMPOSITION AND SURFACTANT USEFUL THEREIN

Emulsified fuel compositions and surfactants useful therein are well known in the art. However prior emulsified fuel compositions suffer from a number of disadvantages. Many of these compositions give undesirably low heat output in terms of BTU's per pound of fuel oil. Other fuel compositions do not burn cleanly and produce undesirable smoke and pollution. Furthermore many emulsified fuel compositions cannot be employed in old boilers and still meet current strict anti-pollution standards. An additional disadvantage of prior emulsified fuel compositions is the high cost of boiler cleaning.

Accordingly it is an object of the present invention to provide an improved emulsified fuel composition which gives a higher heat output in BTU's per pound of oil than prior compositions.

Another object is to provide an improved emulsified fuel composition which burns cleanly, burns with reduced smoke, and reduced pollution.

Yet another object is to provide an improved emulsified fuel composition which can advantageously be employed in older boilers while still meeting current anti-pollution standards.

Another object of the present invention is to provide an improved surfactant especially useful for the emulsification of fuel oil, which surfactant can be employed in exceedingly small and therefore economical quantities.

The above and other objects are accomplished according to the present invention by providing an emulsified fuel composition comprising fuel oil, water, and a surfactant. In accordance with the present invention the surfactant comprises nitrobenzene, benzene, a fatty monocarboxylic acid, an alkylene oxide condensate, and a hydrocarbon oil.

The nitrobenzene aids in the dispersion of the surfactant. The nitrobenzene generally comprises from 1 to 40 and preferably comprises from 5 to 30 weight percent of the surfactant.

The benzene improves the color of the resultant composition and tends to increase the BTU output per pound of oil. The benzene is generally present in an amount equal to 1 to 40 and preferably equal to 5 to 30 weight percent based on the weight of the surfactant.

Another essential ingredient of the surfactant is the fatty monocarboxylic acid. According to the broadest aspects of the present invention any fatty monocarboxylic acid including unsaturated acids can be employed. However the preferred acids are saturated acids containing from 8 to 30 carbon atoms. Examples of suitable unsaturated fatty monocarboxylic acids include among others oleic, linoleic, and linolenic acid. Examples of suitable saturated fatty monocarboxylic acids include among others palmitic acid and stearic acid which is the most preferred. The fatty monocarboxylic acid generally comprises 1 to 20 and preferably comprises from 5 to 15 weight percent based on the weight of the surfactant.

Yet another essential ingredient of the surfactant is the alkylene oxide condensate. The alkylene oxide can be propylene oxide or ethylene oxide but the latter is preferred. In the broadest aspects of the present invention the alkylene oxide can be condensed with any material with which the alkylene oxide is reactable. However the preferred materials are lower alcoholds, fatty alcohols, fatty esters of lower alcohols, fatty acids and alkyl phenol. The alkylene oxide chain can be of any length but generally comprises from 10 to 40 alkylene oxide units. Nonionic surfactants are preferred. An especially preferred subclass is the ethylene oxide condensate of the formula $H(CH_2CH_2O—_nR$ wherein R is a member selected from the group consisting of residues of lower alcohols and residues of monocarboxylic acid esters of lower alcohols, and n is an integer from 10 to 40 inclusive. The alkylene oxide condensate is generally present in an amount equal to 1 to 20 and preferably equal to 5 to 15 weight percent based on the weight of the surfactant.

According to another aspect of the present invention the surfactant preferably comprises a hydrocarbon oil in an amount sufficient to dissolve and disperse the other ingredients of the surfactant. The hydrocarbon oil can be of identical composition to the fuel oil or can be of a different composition. Examples of suitable hydrocarbon oils include among others No. 4 fuel oil, No. 6 fuel oil, Bunker C fuel oil, kerosene, Bunk oil and diesel oil. The hydrocarbon oil is generally present in an amount sufficient to dissolve the other ingredients and generally comprises from 2 to 50 weight percent of the surfactant.

The fuel oil useful in the composition of the present invention is generally a hydrocarbon fuel oil having a boiling point of 200° to 400° C. Examples of suitable fuel oils include among others No. 4 fuel oil, No. 6 fuel oil, and Bunker C fuel oil.

The water useful in the composition of the present invention can be any naturally occurring water with or without the presence of common minerals and salts. Both soft water and hard water can be employed in the composition of the present invention. Salt water having the general constituents found in ocean water is marginally acceptable but is not preferred. The water and the fuel oil can be mixed in widely varying ratios but good results are achieved when the water comprises from 30 to 60 weight percent of the composition. Optimum results are achieved when the water comprises from 40 to 50 weight percent of the composition. It has been unexpectedly determined that the BTU's per pound of oil is reduced when operating much outside of these ranges.

The emulsified fuel composition may be either a water-in-oil or an oil-in-water emulsion though preferably the fuel oil is the continuous phase and the water is the discontinous phase.

The surfactant is generally present in the emulsified fuel composition in an amount equal to 10 to 1000 cc. and preferably equal to 50 to 500 cc. per metric ton of composition.

The invention may be better understood by reference to the following examples wherein all parts and percentages are by weight unless otherwise indicated. These examples are intended to teach those skilled in the art how to practice the invention and represent the best mode presently known for carrying out the invention.

EXAMPLE 1

This example is illustrative of the synthesis of a surfactant useful in the present invention.

The following percentages of the following ingredients are combined as indicated:

| Item | Ingredient | Percent |
|---|---|---|
| A | Nitrobenzene | 20 |
| B | Benzene | 20 |

-continued

| Item | Ingredient | Percent |
|---|---|---|
| C | Stearic Acid | 8 |
| D1 | PEG 400 | 8 |
| D2 | TWEEN 80 | 4 |
| E1 | Bunk Oil | 20 |
| E2 | Diesel Oil | 20 |
| | | 100 |

Items E1 and E2 are mixed and heated to 30° C. whereupon Item C is added followed by the addition of the additional ingredients listed above.

The PEG 400 is a polyethylene glycol condensate with a molecular weight of 400 and is available from the Armour Chemical Company.

The TWEEN 80 is the ethylene oxide condensate of sorbitan monooleate and is available from the Atlas Chemical Company.

As can be seen by reference to the Table although the heat output of the composition drops as shown in Column 8 the heat output per pound of oil increases as shown in Column 9. Since water is less expensive than oil cost per BTU is reduced in accordance with the present invention. Furthermore as shown in Column 10 the flame temperature is not adversely affected.

Furthermore it has been observed that the composition of the present invention burns cleanly with reduced smoke and reduced pollution and that the composition of the present invention can be employed in old boilers while still meeting current pollution standards and further that the cleaning frequency of boilers is reduced.

Although the present invention has been described in considerable detail with reference to certain preferred embodiments it will be understood that various modifications can be made within the scope of the invention without departing from the scope of the appended claims.

TABLE

| 1. EXAMPLE (No.) | 2. WATER (%) | 3. OIL (%) | 4. SURFACTANT (cc/Ton) | 5. MIXER SPEED (RPM) | 6. MIXING TIME (Min.) | 7. SPECIFIC GRAVITY (API) | 8. HEAT OUTPUT PER LB. OF COMP. (BTU/lb.) | 9. HEAT OUTPUT PER LB. OF OIL (BTU/lb.) | 10. FLAME TEMP. (°C.) |
|---|---|---|---|---|---|---|---|---|---|
| 2 | 0% | 100 | 0 | 0 | 0 | 0.906 | 18746 | 18746 | 1100–1600 |
| 3 | 10% | 90 | 250cc | 120–300 | 3–10 | 0.960 | 17636 | 19596 | 1100–1600 |
| 4 | 20% | 80 | 250cc | 120–300 | 3–10 | 0.960 | 16120 | 20150 | 1100–1600 |
| 5 | 30% | 70 | 250cc | 120–300 | 3–10 | 0.964 | 15920 | 22743 | 1100–1550 |
| 6 | 40% | 60 | 250cc | 120–300 | 3–10 | 0.965 | 15601 | 26002 | 1100–1550 |
| 7 | 50% | 50 | 250cc | 120–300 | 3–10 | 0.965 | 15375 | 30750 | 1100–1500 |
| 8 | 60% | 40 | 250cc | 120–300 | 10–15 | — | — | — | — |
| 9 | 70% | 30 | 250cc | 120–300 | 15–30 | — | — | — | — |

EXAMPLES 2–9

These examples illustrate the advantageous properties of the composition of the present invention. Example 2 is not representative of the present invention but rather is a control example relating to the use of pure oil containing no water. Examples 3–9 are examples containing varying amounts of water.

Referring first to Example 3 an emulsified fuel composition was created by mixing 10% of water as shown in Column 2 of the Table with 90% of oil as shown in Column 3 of the Table. To the composition was added 250 cc per metric ton of surfactant as shown in Column 4 of the Table. A mixer was employed rotating at 120 to 300 revolutions per minute as shown in Column 5 of the Table. The mixing time varied from 3 to 10 minutes as shown in Column 6 of the Table. The resultant emulsion had a specific gravity of 0.960 API as shown in Column 7 of the Table. The heat output of the composition was measured according to ASTM Test No. D-240 and was found to be 17,636 BTU's per pound of composition as recorded in Column 8 of the Table. Dividing the entry in Column 8 of the Table by the percentage of water as shown in Column 3 of the Table gives a value of 19,596 BTU's per pound of oil as recorded in Column 9 of the Table. The flame temperature of the burning composition was measured and was recorded in Column 10 of the Table. The surfactant employed in Example 3 is the surfactant produced in Example 1 herein.

Examples 4–9 are identical to Example 3 except that the amounts of water and oil are as shown in Columns 2 and 3 of the Table.

Example 2 is a control example showing corresponding values for oil containing no water.

What is claimed is:

1. An emulsified fuel composition consisting essentially of:

I. a continuous phase of hydrocarbon fuel oil having a boiling point of 200° to 400° C., II. a discontinuous phase of water;

III. a surfactant consisting essentially of:

A. nitrobenzene in an amount equal to 5 to 30 weight percent based on the weight of surfactant;

B. benezene in an amount equal to 5 to 30 weight percent based on the weight of surfactant;

C. stearic acid in an amount equal to 5 to 15 weight percent based on the weight of surfactant;

D. an ethylene oxide condensate of the formula $H(CH_2CH_2O—_nR$ wherein R is a member selected from the group consisting of the residues of lower alcohols and the residues of monocarboxylic acid esters of lower alcohols, wherein n is an integer 10 to 40 inclusive, and wherein the condensate is present in an amount equal to 5 to 15 weight percent based on the weight of surfactant, and E. a hydrocarbon oil constituting the balance of the surfactant, wherein the water is present in an amount equal to 40 to 50 percent of the composition, wherein the surfactant is present in an amount equal to 50 to 500 cc per metric ton of composition.

2. A surfactant consisting essentially of:

A. nitrobenzene in an amount equal to 5 to 30 weight percent based on the weight of surfactant;

B. benzene in an amount equal to 5 to 30 weight percent based on the weight of surfactant;

C. stearic acid in an amount equal to 5 to 15 weight percent based on the weight of surfactant;

D. an ethylene oxide condensate of the formula $H(CH_2CH_2O-_nR$ wherein R is a member selected from the group consisting of the residues of lower alcohols and the residues of monocarboxylic acid esters of lower alcohols, wherein n is 10 to 40, and wherein the condensate is present in an amount equal to 5 to 15 weight percent based on the weight of surfactant, E. a hydrocarbon oil constituting the balance of the surfactant.

* * * * *